US007969315B1

(12) United States Patent
Ross et al.

(10) Patent No.: US 7,969,315 B1
(45) Date of Patent: Jun. 28, 2011

(54) SENSOR DEVICE AND METHOD FOR MONITORING PHYSICAL STRESSES PLACED UPON A USER

(75) Inventors: Janice Marie Ross, Mansfield, TX (US); Johnny Ross, Jr., Mansfield, TX (US)

(73) Assignee: MedHab, LLC, Mansfield, TX (US)

( * ) Notice: Subject to any disclaimer, the term of this patent is extended or adjusted under 35 U.S.C. 154(b) by 384 days.

(21) Appl. No.: 12/128,498

(22) Filed: May 28, 2008

(51) Int. Cl.
*G08B 23/00* (2006.01)
*G08B 1/08* (2006.01)
*A43B 3/00* (2006.01)

(52) U.S. Cl. ..... 340/573.1; 340/539.11; 340/539.12; 340/665; 340/666; 36/1

(58) Field of Classification Search ..... 340/573.1
See application file for complete search history.

(56) References Cited

U.S. PATENT DOCUMENTS 5,373,651 A 12/1994 Wood
5,452,269 A 9/1995 Cherdak
5,619,186 A * 4/1997 Schmidt et al. ..... 340/573.1
5,724,265 A 3/1998 Hutchings
5,815,954 A 10/1998 Huang
5,875,571 A 3/1999 Huang
6,356,856 B1 3/2002 Damen et al.
6,578,291 B2 6/2003 Hirsch et al.
6,807,869 B2 * 10/2004 Farringdon et al. ..... 73/862.046
7,277,021 B2 10/2007 Beebe et al.
7,596,891 B2 * 10/2009 Carnes et al. ..... 36/132
7,607,243 B2 * 10/2009 Berner et al. ..... 36/136
2003/0163287 A1 * 8/2003 Vock et al. ..... 702/187
2007/0049853 A1 3/2007 Adams

OTHER PUBLICATIONS

Author: Jan Brutovsky and Daniel Novak; Title: Low Cost Rehabilitation System for Post-operation Exercises; Date of publication: Aug. 30, 2006; http://embc2006.njit.edu.

* cited by examiner

*Primary Examiner* — Donnie L Crosland
(74) *Attorney, Agent, or Firm* — Eric Karich

(57) ABSTRACT

A sensor device for monitoring physical stresses placed on a user has a sensor body with pressure sensors for sensing pressure and generating a pressure data signal indicating the pressures sensed. An alert mechanism functions to alert the user when the pressure sensed by the pressure sensors exceeds predetermined threshold force levels. The sensor device is utilized to enable a method of monitoring the physical stresses and alerting the user when the predetermined threshold force levels are exceeded.

8 Claims, 4 Drawing Sheets

SENSOR DEVICE AND METHOD FOR MONITORING PHYSICAL STRESSES PLACED UPON A USER

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to sensor devices, and more particularly to a sensor device and method for monitoring physical stresses placed on a user, such as during physical rehabilitation exercises and the like, and alerting the user if the physical stresses exceed predetermined threshold force levels.

2. Description of Related Art

Beebe et al., U.S. Pat. No. 7,277,021, teaches a device for determining the wear of a sole of a shoe, to determine when the shoe is worn out and needs to be replaced. The device includes first and second sensors receivable in the sole of the shoe. The sensors are axially spaced and generate signals in response to corresponding impact forces acting thereon. A control circuit connectable to the first and second sensors compares the difference between the first and second signals to a threshold and generates an alert signal in response to the difference between the first and second signal meeting the threshold, thereby indicating that the shoe needs to be replaced, at which point an LED is illuminated. A similar device is shown in Hirsch et al., U.S. Pat. No. 6,578,291, which teaches a shoe having a built-in, electronic wear indicator device. The device includes an accelerometer for measuring foot movement.

Damen et al., U.S. Pat. No. 6,356,856, teaches a system built into a shoe or measuring the speed of a person while running or walking. An acceleration sensor measures the acceleration in the forward direction and provides an acceleration signal which is amplified and subsequently sampled by analog to digital converter. The digital signal is processed by a microprocessor which executes an algorithm that determines the stride length and the stride duration from the digitized acceleration signal and calculates the speed and the distance traversed. The information thus obtained is transmitted by an RF transceiver to a watch or other device which includes a display which can be viewed by the runner or walker. The speed and distance traversed is displayed on the display, along with other useful information, such as average speed, maximum speed, total distance traversed, calories expended, and heart beat.

Similar shoes are also shown in Huang, U.S. Pat. No. 5,875,571, Huang, U.S. Pat. No. 5,815,954, Hutchings, U.S. Pat. No. 5,724,265, and Huang, U.S. Pat. No. 5,661,916.

Cherdak, U.S. Pat. No. 5,452,269, teaches an athletic shoe which includes a timing device for measuring the amount of time the athletic shoe is off the ground and in air. The athletic shoe includes a notification device which can be operatively coupled to the timing device for notifying a wearer of the amount of time the athletic shoe is off the ground and in the air.

Wood, U.S. Pat. No. 5,373,651, teaches footwear adapted to measure the number and the force of steps that have been taken by the user during a predetermined interval. The wearer can subsequently transfer the step information into a computer for further analysis via an inductively coupled data link between the footwear and the computer.

Adams et al., U.S. 2007/0049853, teaches a compression device for a limb of a patient for applying a predetermined amount of pressure to the limb, and for reporting the pressure actually applied to the limb via an external reporting device. The compression device includes an inflatable sleeve arranged to surround the limb, and a conduit attached to the sleeve arranged to deliver fluid to the sleeve for providing the pressure. A control system controls fluid flow in the device and a memory arranged to store gathered data relating to use of the device.

The above-described references are hereby incorporated by reference in full.

SUMMARY OF THE INVENTION

The present invention teaches certain benefits in construction and use which give rise to the objectives described below.

The present invention provides a sensor device for monitoring physical stresses placed on a user. The sensor device includes a sensor body having pressure sensors for sensing pressure and generating a pressure data signal indicating the pressures sensed. An alert mechanism functions to alert the user when the pressure sensed by the pressure sensors exceeds predetermined threshold force levels.

A primary objective of the present invention is to provide a sensor device having advantages not taught by the prior art.

Another objective is to provide a sensor device for monitoring physical stresses placed on a user, such as during physical rehabilitation exercises and the like, and providing an alert in the event that threshold force levels are exceeded.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a sensor system 10 for monitoring physical stresses placed on a user 12, such as during physical rehabilitation exercises and the like, and providing an alert in the event that threshold force levels are exceeded.

Figure 1:
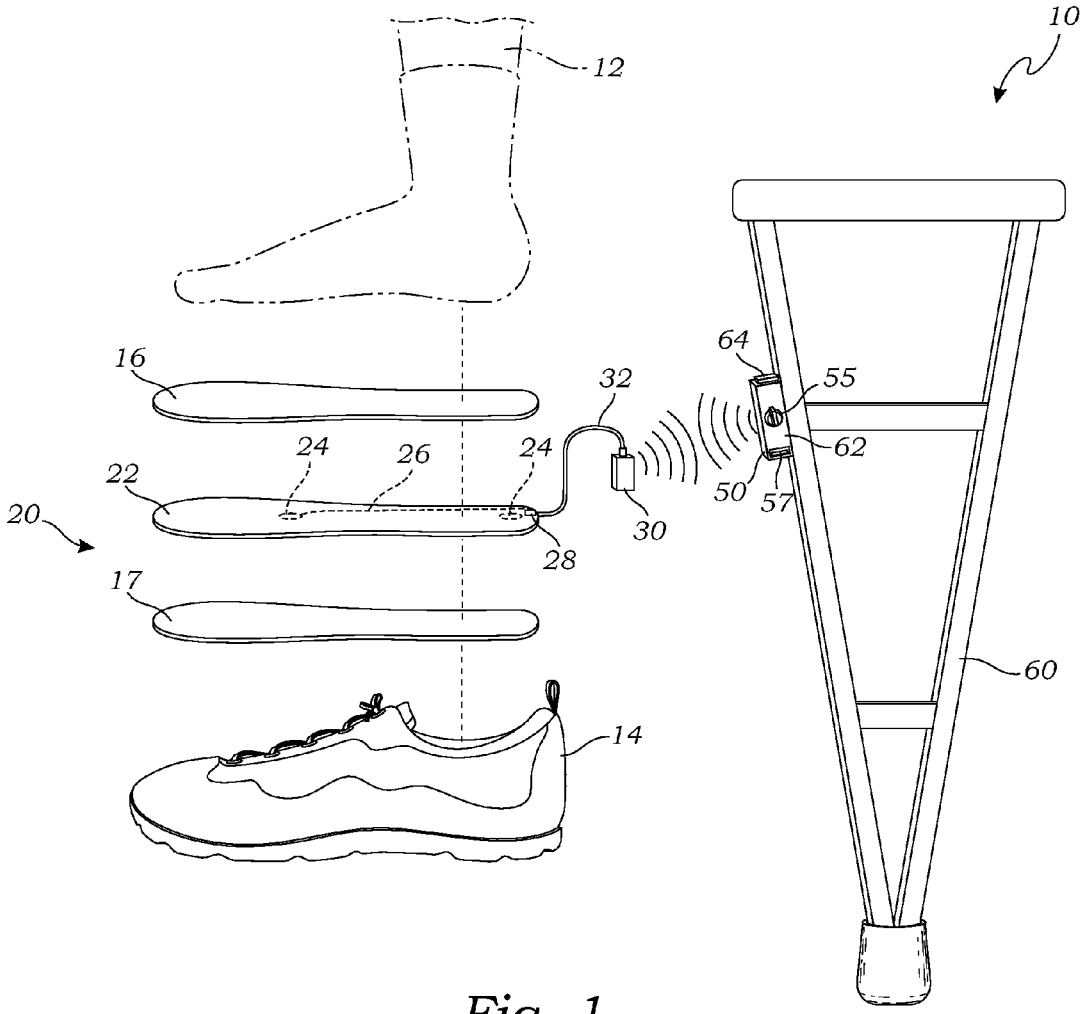
FIG. 1 is a perspective view of a sensor system according to one embodiment of the present invention.
Figure 2:
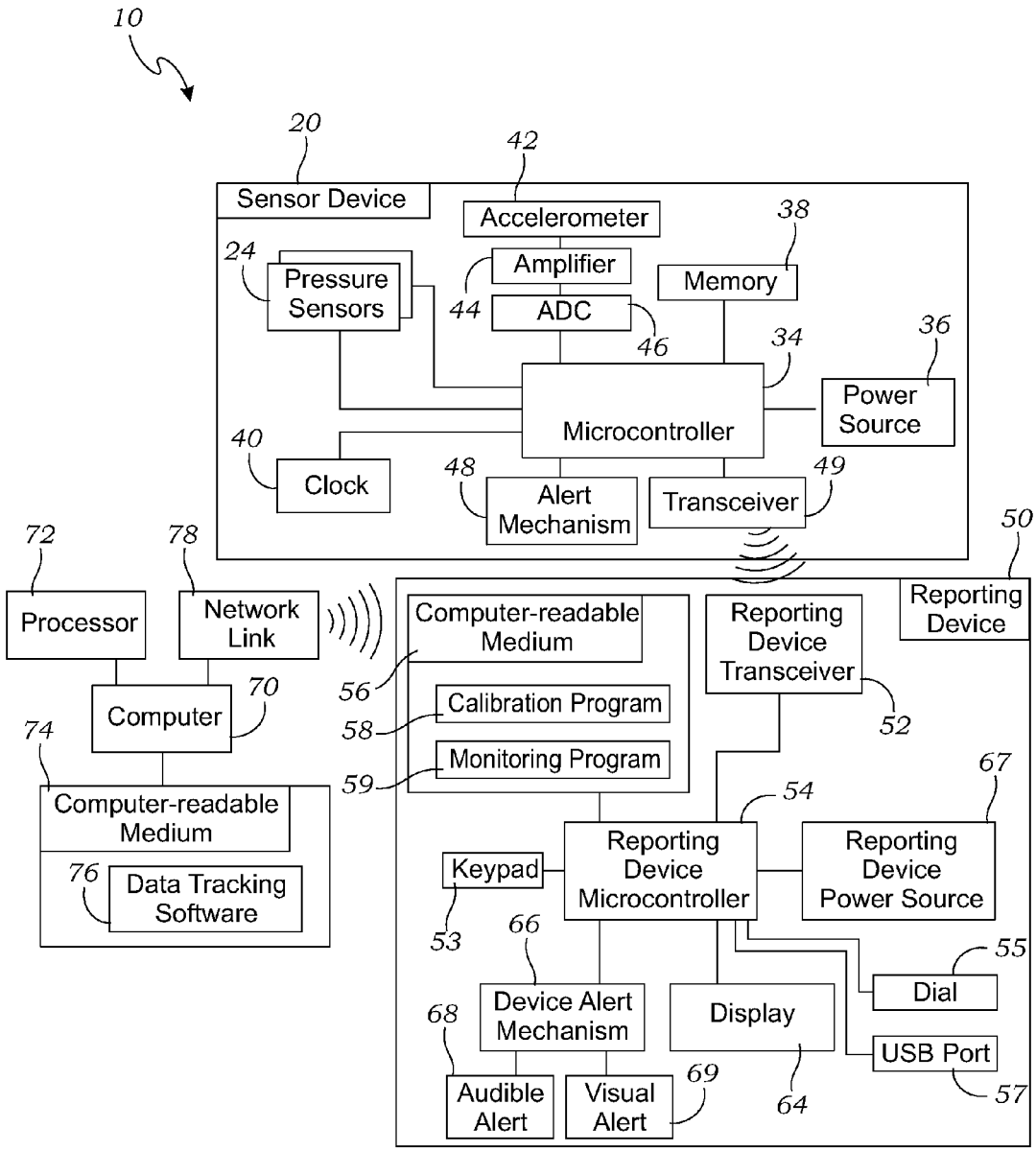
FIG. 2 is a block diagram thereof.

FIG. 1 is an exploded perspective view of the sensor system 10 according to one embodiment of the present invention, and FIG. 2 is a block diagram thereof. As shown in FIGS. 1 and 2, the sensor system 10 may include a sensor device 20 and a separate reporting device 50. An alternative embodiments, however, the sensor system 10 may also be in the form of a single device.

The sensor device 20 may include a sensor body 22 adapted to be positioned within a shoe 14. Pressure sensors 24 are operably mounted on the sensor body 22 for sensing pressure from the user 12 placed upon the shoe 14. The pressure sensors 24 function to generate a pressure data signal indicating the pressures sensed. In the embodiment of FIG. 1, the sensor device 20 is positioned between an insole 16 and a protective layer 17. The insole 16 and the protective layer 17 provide a comfortable bearing surface for the user 12, as well as protect the sensor body 22 from inadvertent damage.

The sensor body 22 may be constructed of a flexible printed circuit board (PCB) having two of the pressure sensors 24 (or any other number of pressure sensors, as determined suitable by one skilled in the art) mounted thereupon and electrically conductive leads 26 connecting the two pressure sensors 24 to a wire mounting point 28. The flexible printed circuit board may be formed of any suitable substrate (e.g., plastic, polyester, etc.) using techniques that are known in the art.

The sensor body 22 may further include a rigid electronics housing 30 adapted to be mounted on an exterior surface of the shoe 14, and an electrically conductive wire 32 extending from the wire mounting point 28 of the sensor body 22 to the rigid electronics housing 30. The rigid electronics housing 30 may include a microcontroller 34, a power source 36, a memory 38, and a clock 40. The term "microcontroller" is hereby defined to include any chip(s) and/or circuit(s) that function to operably connect and control the various elements of the sensor device 20 as described herein. The memory 38 may include a computer readable medium for storing programs, as described below, and/or an electronic storage (e.g., RAM, ROM, etc.) for storing predetermined storing threshold force levels, and/or readings received from the pressure sensors 24.

In one embodiment, the rigid electronics housing 30 includes the alert mechanism 48, such as a beeper, buzzer, flashing light, etc., so that the sensor device 20 can not only received the readings from the pressure sensors 24, it can also alert the user 12 when the pressure sensors 24 report pressure readings greater than the predetermined threshold force levels. In the embodiment of FIGS. 1 and 2, however, the pressure readings are reported to the reporting device 50 for analysis and for alerting the user 12 via the reporting device 50.

The rigid electronics housing 30 of the sensor device 20 may further include an accelerometer 42 operably connected to the microcontroller 34 through an amplifier 44 and an analog to digital converter (ADC) 46. The accelerometer 42 tracks the movements of the foot of the user 12. The history of movement of the foot of the user 12, in conjunction with the pressure sensor 24 readings, create a detailed history of the user's movements that enable a doctor to later analyze the data and determine the user's movements and how the user 12 may have been correctly and/or incorrectly exerting the leg. For example, if the user 12 routinely places too much stress on the leg while climbing stairs, the doctor could determine this fact and advise the user 12 to be more careful on stairs, or to avoid them entirely if necessary.

In the embodiment of FIGS. 1 and 2, the sensor device 20 may further include a transceiver 49 for transmitting the pressure data signal (and/or data from the accelerometer 42) to the reporting device 50. The term "transceiver" as used in this application is hereby defined to include any form of sending and/or receiving information, including but not limited to any form of wireless communication, transponder, and/or wired communications device and/or connection. For example, any USB port 57 may enable a wired connection to the reporting device 50 and/or other computer devices.

As illustrated in FIGS. 1 and 2, the reporting device 50 may include a reporting device transceiver 52 for receiving the pressure data signal. As discussed above, the connection between the transceiver 49 and the reporting device transceiver 52 is preferably wireless; however, in alternative embodiments it may be a wired connection.

The reporting device 50 may include a reporting device microcontroller 54 operably connected to computer-readable medium 56. The computer-readable medium 56 includes a calibration program 58, a monitoring program 59, and any other programs and/or software necessary for the function of the reporting device 50. The calibration program 58 functions to store threshold force levels. In one embodiment, for example, when a user 12 receives the reporting device 50, he or she first inputs his or her weight, and/or any other pertinent information. The information may be downloaded electronically through the USB port 57, entered via a keypad 53, or otherwise inputted via mechanisms well known in the art.

The user 12 may also input what percentage of weight he or she should place upon the leg, or some other measure of stress advised by a doctor. In one embodiment, a percentage of stress is inputted by turning a dial 55. In another embodiment, a specific amount of force may be specified, and downloaded into the reporting device 50 using any mechanism described herein, or any alternative mechanism known to those skilled in the art.

The calibration program 58 functions to analyze the data that is inputted (e.g., the users weight and percentage of weight advised by doctor, direct input of force level, etc.) and determine the threshold force levels that are acceptable, and the threshold force levels that will trigger of alert. It is possible that the reporting device 50 only analyze a single threshold force level, such as a maximum pressure received, or it may track multiple threshold force levels, various forms of averages of forces detected, and/or may also track various forms of torque, sustained pressure, instant pressure, or more specific forces that may very be particularly damaging to a person's leg. Such parameters may be devised by those skilled in the art, and any such method should be considered within the scope of the present invention.

The monitoring program 59 determines if the pressure data signal indicates that the pressure exceeds one of the threshold force levels. As discussed above, treating doctors and others skilled in the art may devised many alternative methods of analyzing the threshold force levels to determine when a warning is required. In its simplest form, the monitoring program 59 merely measures forces sensed by the pressure sensors 24, and sounds an alert if those forces exceed a certain level. In alternative embodiments, a more sophisticated analysis might be used, and such alternatives should be considered within the scope of the present invention.

The reporting device microcontroller 54 is operably connected to a reporting device alert mechanism 66 for alerting the user 12 when the threshold force levels are exceeded. In one embodiment, the reporting device alert mechanism 66 may include an audible alert 68 such as a speaker for admitting a warning, a buzzer, or any other form of audible alert known to one skilled in the art. In another embodiment, the reporting device alert mechanism may include a visual alert 69 such as a plurality of LEDs or other visual display elements. The visual alert 69 may also include data displayed on a display 64 (e.g., an LCD screen, LED display, etc.). Various other forms of alert mechanisms may also be included, including vibrating elements, electronic reporting elements (e.g., e-mail, instant message, etc.), flashing lights, sirens, and/or any other alert mechanisms known in the art.

In the embodiment of FIG. 1, a reporting device housing 62 containing the reporting device 50 is operably mounted on a crutch 60. The sensor device 20 is operably positioned in the shoe 14 worn by the user 12, and when the user 12 walks using the crutch 60, the reporting device 50 is maintained proximate to both the user 12 and the shoe 14. When the user 12 steps too hard upon the shoe 14, the readings from the pressure sensors 24 are transmitted via the transceiver 49 of the sensor device 20 to the reporting device transceiver 52 of the reporting device 50. When the monitoring program 59 determines that the force levels reported exceed the acceptable threshold force levels, the device alert mechanism 66 triggers an alert, such as the audible alert 68 (e.g., siren or beeping sound), and/or the visual alert 69 (e.g., LEDs flashing a warning).

The reporting device 50 may be powered by a reporting device power source 67 (e.g., battery, solar cell, or any other source of power suitable for powering the reporting device 50) operably connected to the reporting device microcontroller 54.

Figure 3:
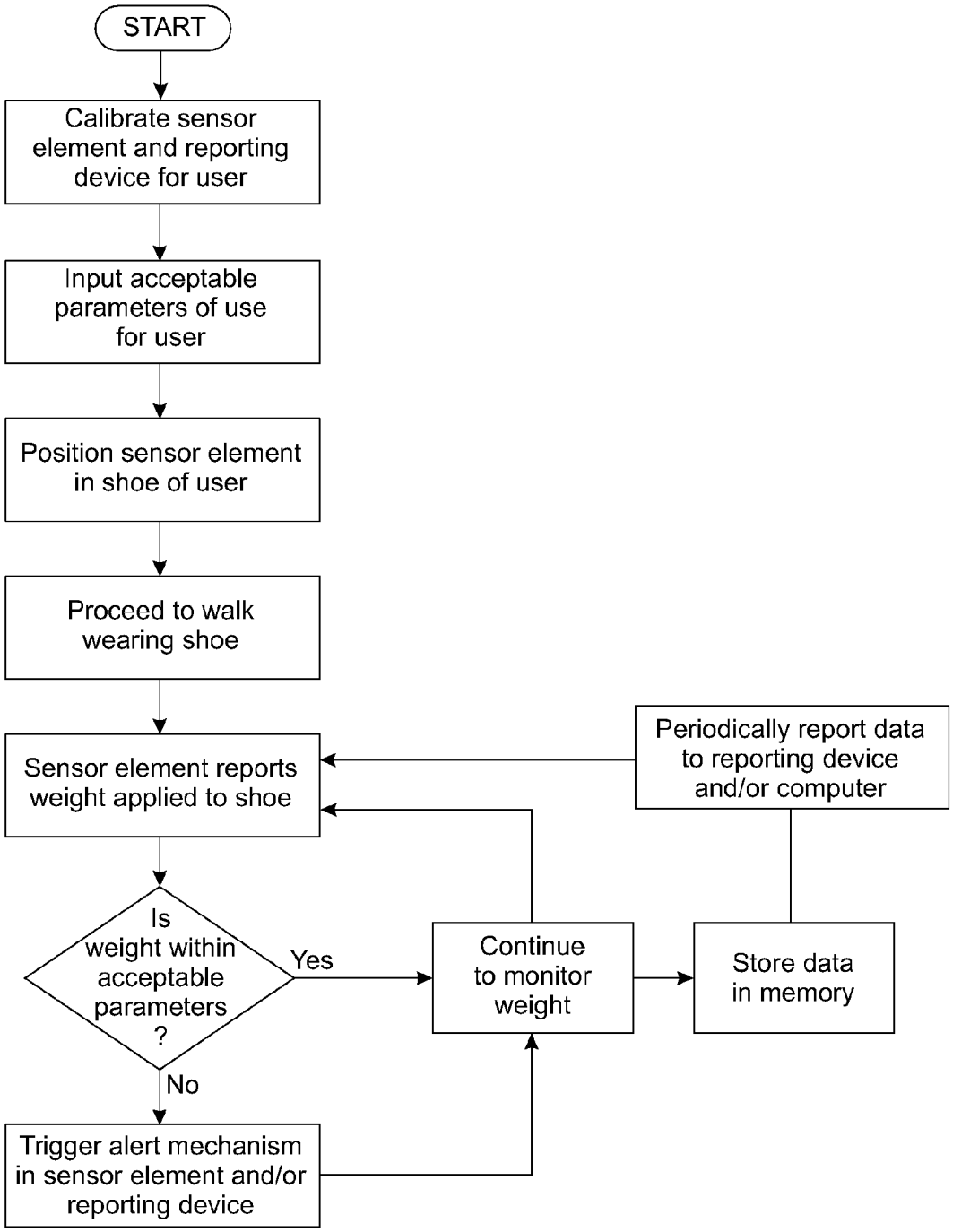
FIG. 3 is a flow diagram of the operation of the sensor system.

FIG. 3 is a flow diagram of the operation of the sensor system 10 for monitoring the physical stresses placed on the user 12 (such as his or her leg) and alerting the user 12 if the stresses exceed the predetermined threshold level. As illustrated in FIG. 3, the method includes the step of first providing the sensor device 20 described above.

The sensor system 10 of FIGS. 1 and 2 is first calibrated using the calibration program 58 described above. Relevant data, such as the users weight, is transferred to the reporting device 50 as discussed above. Acceptable force parameters, specific treatment parameters provided by a doctor, and/or any other data and/or treatment options may also be transferred. In one embodiment, as illustrated in FIG. 1, the dial 55 of the reporting device 50 is turned to the percentage of force that is recommended by the doctor. The predetermined threshold force levels that should not be exceeded are determined and stored.

Once calibrated, the sensor device 20 is operably positioned so that the pressure sensors 24 sense the stresses placed upon the user 12 (such as the user's leg). In the embodiment of FIG. 1, the sensor device 20 is placed inside the shoe 14 between the insole 16 and the protective layer 17, or otherwise positioned in or on the shoe 14 for sensing pressures placed upon the shoe 14 by the user 12.

The user 12 then walk about, while wearing the shoe 14, and the sensor system 10 monitors the pressure data signal to determine if the pressure exceeds one of the threshold force levels. The user 12 is then alerted if the threshold force levels are exceeded, as discussed in greater detail above. If the user 12 is walking across the room, and here she receives a warning signal, he or she will know to adjust his or her walk so that he or she is only exerting a suitable amount of stress upon the leg. If the user 12 is walking up stairs, and receives a warning, he or she will know to be more careful in climbing the stairs, so that he or she is not placed too much strain upon the leg.

In one embodiment, as illustrated in FIG. 2, the sensor system 10 further includes a computer 70 that includes a processor 72 and a computer readable medium 74. The computer readable medium 74 includes a data tracking software 76 that operably interacts with the reporting device 50 via a network link 78. The network link 78 may be any form of wired or wireless network connection, either direct or via the Internet, so that the data tracking software 76 can interact with the reporting device 50. The pressure data signal and/or any alerts received from the sensor device 20 and/or reported to the reporting device 50 are directed to the computer 70 for analysis using the data tracking software 76. Data from the accelerometer 42 may also be reported, so that the pressure data and alerts may be placed into context with the user's movements.

For example, the user's doctor may analyze the reported data and/or alerts to determine whether the user 12 is correctly following his or her exercise regime, and/or whether or not he or she is over-exerting himself or herself. The doctor might also determine whether the user 12 is prone to overstressing his or her leg during certain activities, such as climbing stairs, walking, engaging in activities at certain times of day, or otherwise. Once the doctor has been alerted to this situation, he or she can warn the user 12 against certain activities, or were in the user 12 to be more careful in these activities. The doctor might also determine from the collected data, that the user 12 is not exercising his or her leg enough, and the doctor might recommend that the user 12 get more exercise, and engage in more stressful activity.

Figure 4:
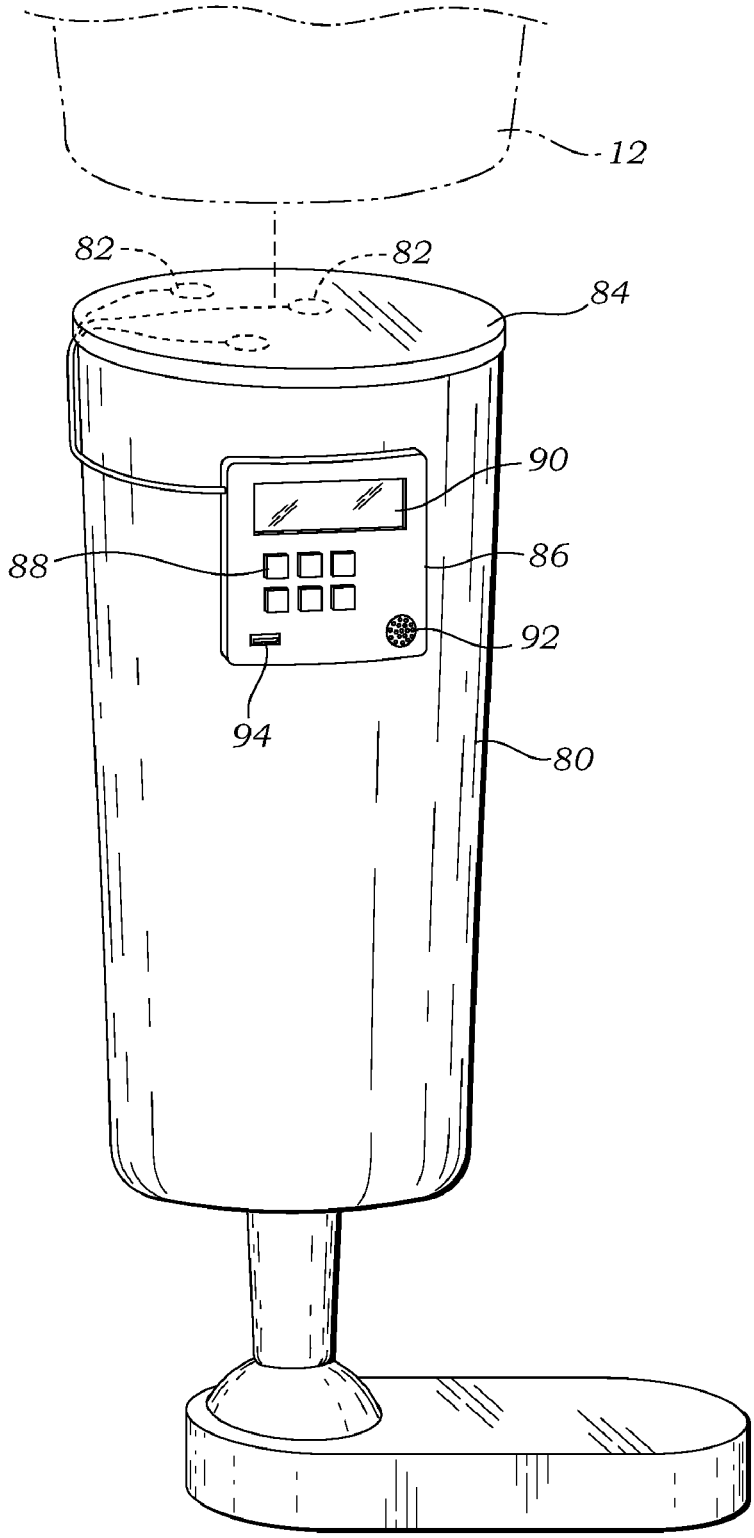
FIG. 4 is perspective view of a prosthesis leg that includes an alternative embodiment of the sensor system.

FIG. 4 is perspective view of a prosthesis leg 80 that includes an alternative embodiment of the sensor system 10. In this embodiment, the prosthesis leg 80 includes sensors 82 and batted in a pad 84, and a reporting device 86 built into the prosthesis leg 80. The reporting device 86 may include control buttons 88 for controlling the operation of the reporting device 86, a displaying 90 for displaying information and for enabling calibration of the device 86, a speaker 92 for sounding the alert, and port 94 (e.g., a USB port, or other data port) for enabling the reporting device 86 to be connected to a computer for calibration and data downloads. The prosthesis leg 80 may further include any of the elements described above, the port 94 may be replaced or supplemented with the transceiver 49 and/or any other form of data transfer mechanism.

In the embodiment of FIG. 4, the prosthesis leg 80 incorporates the elements described above for tracking and the use of the leg 80 so that the user 12 does not place too much strain on his or her leg well using a prosthesis leg 80. While one type of prosthesis is illustrated herein, any form of prosthesis may incorporate the sensors 82 and other elements of the invention for tracking and recording stresses placed upon the user 12 by the prosthesis, and for sounding or otherwise providing an alert in the event that the sensors recorded too great of a strain upon the user 12. As discussed above, this data may also be compiled and analyzed with the computer 77 the doctor may determine whether the prosthesis is being used correctly, or whether the user 12 may need to modify his or her behavior to prevent potential injury.

The terminology used in the specification provided above is hereby defined to include similar and/or equivalent terms, and/or alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one embodiment, it is to be clearly understood by those skilled in the art that the invention is not limited thereto. Rather, the scope of the invention is to be interpreted only in conjunction with the appended claims.

What is claimed is:

1. A sensor device adapted to be positioned within a shoe for monitoring physical stresses placed on a user, the sensor device comprising:

a sensor body adapted to be positioned within the shoe;

pressure sensors operably mounted on the sensor body for sensing pressure from the user placed upon the shoe, the pressure sensors functioning to generate a pressure data signal indicating the pressures sensed;

a sensor housing operably connected with the sensor body;

an accelerometer operably mounted for measuring movement of the sensor device;

a transceiver mounted in the sensor housing for transmitting the pressure data signal and the movement of the sensor device as measured by the accelerometer; and an alert mechanism for alerting the user when the pressure sensed by the pressure sensors exceeds predetermined threshold force levels.

2. The sensor device of claim 1, further comprising a reporting device comprising:

a reporting device microcontroller operably connected to a computer-readable medium;

a reporting device transceiver operably connected with the reporting device microcontroller for receiving the pressure data signal from the transceiver of the sensor device;

a calibration program on the computer-readable medium for storing threshold force levels; and a monitoring program on the computer-readable medium for determining if the pressure data signal indicates that the pressure exceeds the threshold force levels.

3. The sensor device of claim 2, further comprising a crutch having mounted thereupon a reporting device housing containing the reporting device.

4. A sensor system for monitoring physical stresses placed on a user, the sensor system comprising:

a sensor device comprising:

a sensor body adapted to be positioned within a shoe;

pressure sensors operably mounted on the sensor body for sensing pressure from the user placed upon the shoe, the pressure sensors functioning to generate a pressure data signal indicating the pressures sensed;

a transceiver for transmitting the pressure data signal; and an accelerometer operably mounted in the sensor device for measuring movement of the sensor device; and a reporting device comprising:

a reporting device a reporting device transceiver for receiving the pressure data signal;

a monitoring program on a computer-readable medium of the reporting device for determining if the pressure data signal indicates that the pressure exceeds a threshold force level; and an alert mechanism for alerting the user when the threshold force levels are exceeded.

5. The sensor system of claim 4, further comprising a computer that includes a processor and a computer readable medium, the computer readable medium having a data tracking software that operably interacts with the reporting device via a network link so that the pressure data signal generated by the sensor device and reported to the reporting device are directed to the computer for analysis using the data tracking software, and for correlation with data from the accelerometer so that the pressure data may be placed into context with movements tracked by the accelerometer.

6. A method for monitoring physical stresses placed on a user and alerting the user if the stresses exceed a predetermined threshold level, the method comprising the steps of:

storing predetermined threshold force levels that should not be exceeded;

providing a sensor device comprising a sensor body having pressure sensors operably mounted on the sensor body for sensing pressure, and further comprising an accelerometer;

positioning the sensor device so that the pressure sensors sense the stresses placed upon the user, and so that the accelerometer measures movement of the user;

generating a data signal indicating the pressures sensed by the pressure sensors, and the movements of the user as determined by the accelerometer;

monitoring the data signal to determine if the pressure exceeds one of the threshold force levels, or if the movement of the user exceed threshold levels; and alerting the user when the threshold force levels are exceeded, or when the movement exceeds threshold levels.

7. The method of claim 6, further comprising the step of transmitting the pressure data signal and/or any alerts to a computer for analysis using data tracking software.

8. The method of claim 6, further comprising the steps of:

weighing the user;

determining what percentage of the weight of the user should be borne by the user's leg; and calculating the predetermined threshold force levels based upon the weight of the user and the percentage of the weight that should be borne.

* * * * *